US006112784A

United States Patent [19]

Lough

[11] Patent Number: 6,112,784

[45] Date of Patent: Sep. 5, 2000

[54] RAIL BUSTER

[76] Inventor: Sampson A. Lough, 66 Holly River Rd., Webster Springs, W. Va. 26288

[21] Appl. No.: 09/415,570

[22] Filed: Oct. 8, 1999

Related U.S. Application Data

[60] Provisional application No. 60/103,624, Oct. 9, 1998.

[51] Int. Cl.[7] ..... B27L 7/00

[52] U.S. Cl. ..... 144/195.1; 144/193.1; 144/366; 144/195.8

[58] Field of Search ..... 144/2.1, 162.1, 144/193.1, 195.1, 195.8, 366

[56] References Cited

U.S. PATENT DOCUMENTS

| | | | |
|---|---|---|---|
| 1,304,528 | 5/1919 | Anderson | 144/193.1 |
| 2,704,093 | 3/1955 | Brown | 144/195.1 |
| 3,993,113 | 11/1976 | Thackery | 144/194 |
| 4,066,110 | 1/1978 | Sarno | 144/193.1 |
| 4,252,166 | 2/1981 | Kozicki | 144/194 |
| 4,254,808 | 3/1981 | Nokes | 144/193.1 |
| 4,275,779 | 6/1981 | Rowe | 144/193.1 |
| 4,334,562 | 6/1982 | Granlund | 144/195.1 |
| 4,483,379 | 11/1984 | Alkens et al. | 144/195.1 |
| 4,522,241 | 6/1985 | West | 144/193.1 |
| 4,646,800 | 3/1987 | Wentzell | 144/194 |
| 5,495,878 | 3/1996 | McKenen, Jr. | 144/193.1 |

*Primary Examiner*—W. Donald Bray
*Attorney, Agent, or Firm*—Christopher J. Whewell

[57] ABSTRACT

Provided herein is a device useful for splitting logs into rail sections useful in making fences. The device includes a longitudinal cutting means which permits the entire log placed into the device to be cleaved along its length dimension in one operation, without the need for pre-sawing or pre-calculations. Through use of the instant device, wasted lumber is kept to an absolute minimum over methods of prior art. The device of the invention takes up very little space and may be operated by hydraulic or electrical means.

13 Claims, 5 Drawing Sheets

RAIL BUSTER

This application claims the benefit of provisional patent application Ser. No. 60/103,624 which was filed Oct. 9, 1998, which is currently still pending, and the entire contents of which are herein incorporated by reference thereto.

This invention relates to a device and process useful in the timber industry for sculpting raw log sections into a desired shape. More particularly, the invention relates to a device and process for splitting log sections in a direction parallel to their length dimension. The device of this invention is especially well suited to the production of rails for split rail fences, and produces a greatly reduced amount of wasted cuttings from the round logs used as starting materials.

BACKGROUND

As is well known, a number of sawing systems are used to produce fence rails and other shapes of finished wood from logs, including systems which provide for opening a log. The latter are referred to as being of a primary breakdown type. Most primary breakdown sawing systems have available various devices for automatically (e.g., electronically) measuring each log and for using these measurements to increase the rate at which logs are processed through the system—throughput, and/or for improving the value of lumber to be recovered from each log. In order to achieve a high volume of lumber production, it is often desirable to first run each log through a primary breakdown saw to make a first planar cut, and after this is accomplished, to pass the resulting piece or pieces (slabs, cants, or flitches) through one or more resawing operations, the resawing operation being performed by the same or a separate saw. The resawing operation reduces larger pieces into common board thicknesses (e.g., four, eight inches, etc.); then, from the resawing operation, the resulting boards are passed through edgers (for width) and trimmers (for length) to achieve final board widths and lengths.

There are numerous choices available for sawing a log into lumber, and some are clearly better than others. Each log has unique geometry as to, for example, sweep, taper, notch (defects), length, and diameter. The amount of lumber recovered from a log is significantly effected by how these features are oriented to the plane of the primary breakdown saw cut. Thus, for maximum lumber recovery, there must be an initial determination of this plane before the cutting of it in order that the best opening planar cut in the log be made. In the trade, the term "best opening face" is employed to describe this cut. Once that opening face cut is made, the number of choices for sawing the remainder of the log are greatly limited, especially for small diameter logs. Thus, a slight error between an ideal opening face cut and an actual cut (e.g., resulting in an error on the order of .+−. ⅛ to .+−. ¼ inch), may significantly reduce the amount of lumber yield from a log, particularly in the case of logs eight inches or smaller in diameter. It is to be appreciated that in order to determine a "best opening face," the log must first be measured, and with measurements, the log be analyzed, and thereafter, the position of a saw with respect to the log be set.

It is acknowledged that a variety of different sawing systems are presently used to produce boards from logs, including systems which provide for a separate opening of a log, as previously described. In the case of producing fence rails from logs the principles are in general the same, since it is desirable to yield the greatest amount of useful final wood product as possible from a given log. One well known primary cut system is referred to as a Head Rig and Carriage System. While refined to an extent over the years, the basic design of the Head Rig and Carriage System has been in use for the past 100 years. It employs a stationary band or circular saw with a track laid out parallel to this saw (Head Rig). The Carriage of this system is moved back and forth on these tracks past the Head Rig, with the Carriage having movable upright structures which move in generally horizontal guide ways, referred to as head-blocks. Logs are individually rolled onto the Carriage and are held against head-block knees by pointed clamps called dogs. A Carriage-borne log is positioned by using the head-blocks; the Carriage and log are then moved past the saw in successive passes to cut an initial face and then cut the log into acceptable fence rail dimensions. Electro-optical sensors may be used to measure the log after it has been dogged to the Carriage, and these measurements are then used to more intelligently position the log for cutting. The Head Rig and Carriage System can cut accurately-sized fence rails and lumber and can be designed to recover a high percentage of lumber from each log. The throughput of this type system is quite low, on the order of one to three logs per minute.

A second pertinent system is known as a Sharp Chain Primary Breakdown Saw. It employs a precision-guided chain having upwardly pointed teeth, with the chain being routed between a pair of vertical saws and/or chipper heads. Logs are placed on the Chain and conveyed through and past the saws or chipper heads. Sides of a log are removed by the saws (or chipper heads), leaving a center cant or two-sided log mounted to the Sharp Chain. The diameter of a log may be measured as the log is conveyed toward the saws, and these saws are moved toward or away from the Chain track in accordance with the measurements taken. Since logs can be positioned on the Sharp Chain while the log is being sawn, the Sharp Chain System has a higher throughput, on the order of eight to ten logs per minute. However, this system provides a lower lumber recovery per log than the Head and Carriage System since a log cannot be repositioned once it is placed on the Sharp Chain. This means that if a log is initially improperly positioned, it will end up being improperly sawn. Since much of the scanning or log measurement with this type system is done after the log is placed on the track, the probability of improper placement and cutting and lumber waste is considerable.

The Sharp Chain System is more economical, and thus most competitive, when used to cut smaller and more uniform logs, such as are produced in northern forests, e.g., Scandinavia and Canada, while the Head Rig and Carriage System is best suited for larger diameter logs, decreasingly available in number from the Pacific Northwest. However, milling of logs to produce fence rails has to date been generally inefficient and wasteful, with the waste wood simply being converted into chips for the paper industry, or discarded. One reason for this is that logs are often irregular, with considerable sweep, taper, and diameter and length variations, as well as having knots and other defects. These irregularities and the limited volume (for footage) of lumber available in small diameter logs create a need for them not only to be individually analyzed before sawing, but also to be sawn accurately in terms of this analysis in order to recover their maximum value. Furthermore, and most importantly, these combined operations must be performed more rapidly than has heretofore been possible if the full potential utilizing southern pine logs for lumber is to be realized. Accordingly, the object of this invention is to provide a means for providing fence rails from logs without the need for pre-sawing, and to produce fence rails with an absolute minimum of waste.

SUMMARY OF THE INVENTION

The present invention is a device useful for shaping log sections by effecting a. A device according to the invention includes a substantially rectangularly shaped frame portion with two vertical support members and one upper and one lower horizontal support member, in which each horizontal support member includes an upper surface portion and a lower surface portion. There is at least one, and preferably two actuator means in mechanical contact with said upper horizontal support member. Further, the invention includes a longitudinal cutting means oriented parallel to the horizontal support members. The cutting means includes a top surface portion and a cutting edge portion, and the cutting means is disposed between the upper horizontal support member and the lower horizontal support member. The actuator means are also in mechanical contact with the top surface portion of the cutting means. Finally, there is also a guide means for maintaining the cutting means within the plane inherently formed by the vertical and the horizontal support members during motion of the cutting means in a direction parallel to the vertical support members induced by virtue of the action of the actuator means.

During use of the device, a log which is to be split ("workpiece") is placed on the top surface of the lower horizontal support member. Next, hydraulic fluid under pressure is supplied to the actuators in the preferred case where the actuator means are hydraulic actuators, which causes the cutting means to travel in a direction parallel to the vertical support members and towards the workpiece (log) with such force that the workpiece is caused to be split in a direction perpendicular to its length axis. In the case of a single, full round log, the log will initially be cleaved in half. Insertion of the half-log so produced onto the cutting table portion of a device according to the invention for a second cut will thus cause the half section to be cut into a quarter section. Such quarter section may be further easily cut into an eighth section, or used as a quarter section, as a fence rail.

DETAILED DESCRIPTION

Figure 1:
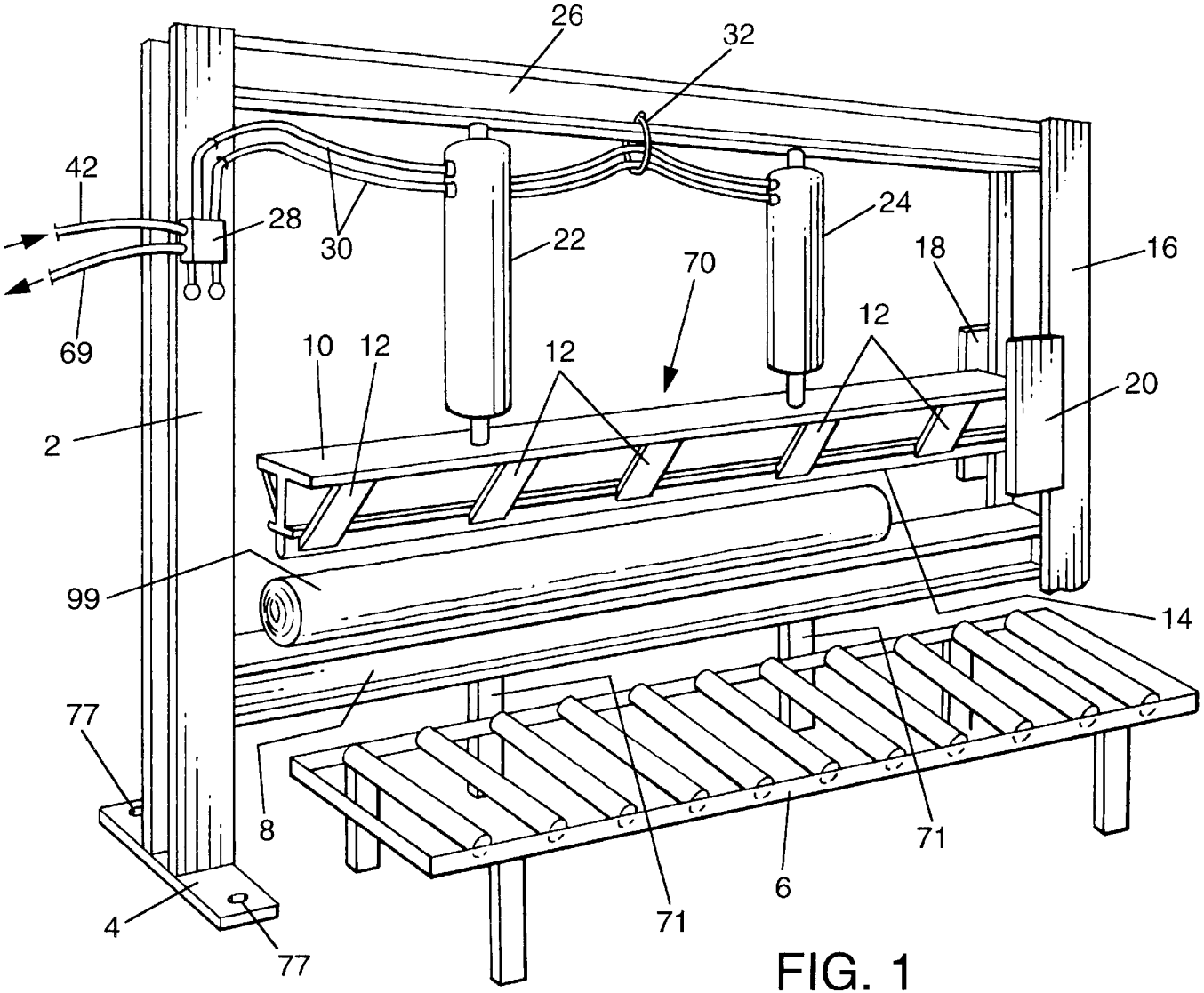
FIG. 1 is a perspective view of a device according to he invention.

Referring to the drawings and initially to FIG. 1, there is shown a longitudinal log splitter according the invention. From this figure it can be seen that the device of the invention comprises a substantially rectangular frame portion which is made up of linear vertical support members 2 and 16, to each of which a linear horizontal support member 26 is attached at its end portions. The lower portion of 16 has been cut away in this figure so as to not interfere with other pictured items, but is the same in all respects as the lower portion of 2. Also shown is a second horizontal support member 8, which serves the dual function in that it is also the cutting table portion of the invention (in its preferred form) upon which the workpiece 99 is located. The cutting means 70 of the invention is also depicted, shown held in position here by hydraulic actuators 22 and 24, and guide portions 18 and 20. When the actuator means are hydraulic actuators, there is also included in the invention lines 30 for transmission of hydraulic fluid to and from the fluid reservoir and pump (not shown) which are held in a rigid position by a strap means 32 and a valve means 28 for thus controlling to motion of the actuators. Roller table 6 is shown in proximity to the cutting table to permit ease of transport of finished workpieces from the vicinity of the device to another location in the work area. The lower horizontal support member may also be strengthened by the placement of support means 71 between the flat surface upon which the device as a whole is desired to rest and the lower surface portion of the second horizontal support member. This is desirable since the forces typically experienced by the lower horizontal support member by virtue of blows driven to it from the cutting means are very strong.

The vertical and horizontal support members are constructed preferably from materials which are structurally very strong in order that they may withstand the tremendous forces encountered by virtue of the delivery of strong blows by the cutting means to the second horizontal support member. Accordingly, the preferred material for constructing these members is I-beam stock typically used in the construction industry for various purposes and well-known to those skilled in the art. Other materials of construction, such as wooden beams, steel pipe, etc. are functionally equivalent to the i-beams used, provided that such provide a construction which does not buckle, warp, or fold during normal use. I-beams are especially preferred or the vertical support members, since they inherently possess a channel, and when oriented with respect to one another as shown in FIG. 1 provide a channel inside of which the cutting means may be guided in its motion, in one form of the invention. The use of such I-beams are convenient also in that the upper horizontal support member may be caused to include a means to attach the actuator means to the support, preferably by welding, or through the use of suitable fasteners through the leg portion of the i-beam, the use of which are well known to those skilled in the art. Use of an i-beam for the lower horizontal support member is advantageous and most preferred because it provides a flat surface upon which the workpiece may be placed, wherein the flat surface functions as the cutting table of the invention and, by virtue of its strength is capable of withstanding hundreds of being repeatedly dealt forces sufficient to split logs longitudinally without distortion.

Attached to the bottom portion of the vertical support members 2 and 16 are support stabilizers 4 and 36 respectively, which are in their preferred form rectangularly shaped steel plates, which are attached perpendicularly to the vertical support members preferably by welding, although other means for connection thereof known to those skilled in the art may be employed as well. Preferably, the stabilizers include one or more holes 77 through their surfaces through which an anchoring means such as a bolt which is affixed to the surrounding substrate may be located.

It is sometimes convenient to employ a roller table 6, that is a supported rectangular framework, the interior of which includes a plurality of rollers. Such a roller table is preferably placed in a position adjacent to the device of the invention, in order to receive workpieces which have been split so that the split workpieces may be routed away from the device efficiently when the device is used in mass manufacturing, as the use of such roller tables are known to those skilled in the art.

There are also shown in FIG. 1 a plurality of actuator means 22 and 24 which are connected to both the first horizontal support member 26 and the cutting means 70, and are used to deliver the necessary force to the cutting means 70 to cleave through a workpiece located on the flat upper surface of the second horizontal support member 8. The actuator means may be any device known to those in the art capable of being attached to the stationary first horizontal support member 26 and the cutting means 70 and causing the motion of the cutting means with sufficient force to cleave a workpiece disposed on the upper surface of the second horizontal support member 8, such as solenoids. However, the most preferred means are hydraulic actuators, as such and their use are well known to those of ordinary skill in the mechanical arts. When hydraulic actuators are employed, there will also be various hydraulic lines 30 associated with the device, including a valve means 28 for controlling the flow of hydraulic fluid, and a supply line 42 from a hydraulic pump and a return line 69 that is connected to a hydraulic fluid reservoir. Hydraulic fluid pumps, reservoirs, and valves for the control thereof employed in the invention are conventional in the art, and the configuration and use thereof well known. One or more supports 32 for the hydraulic lines may be employed when the actuator means is hydraulic, in order to maintain the lines in a safe and non-interfering position. Such strap means may be any means known for holding lines in stable, stationary positions and are well-known in the art.

Figure 2:
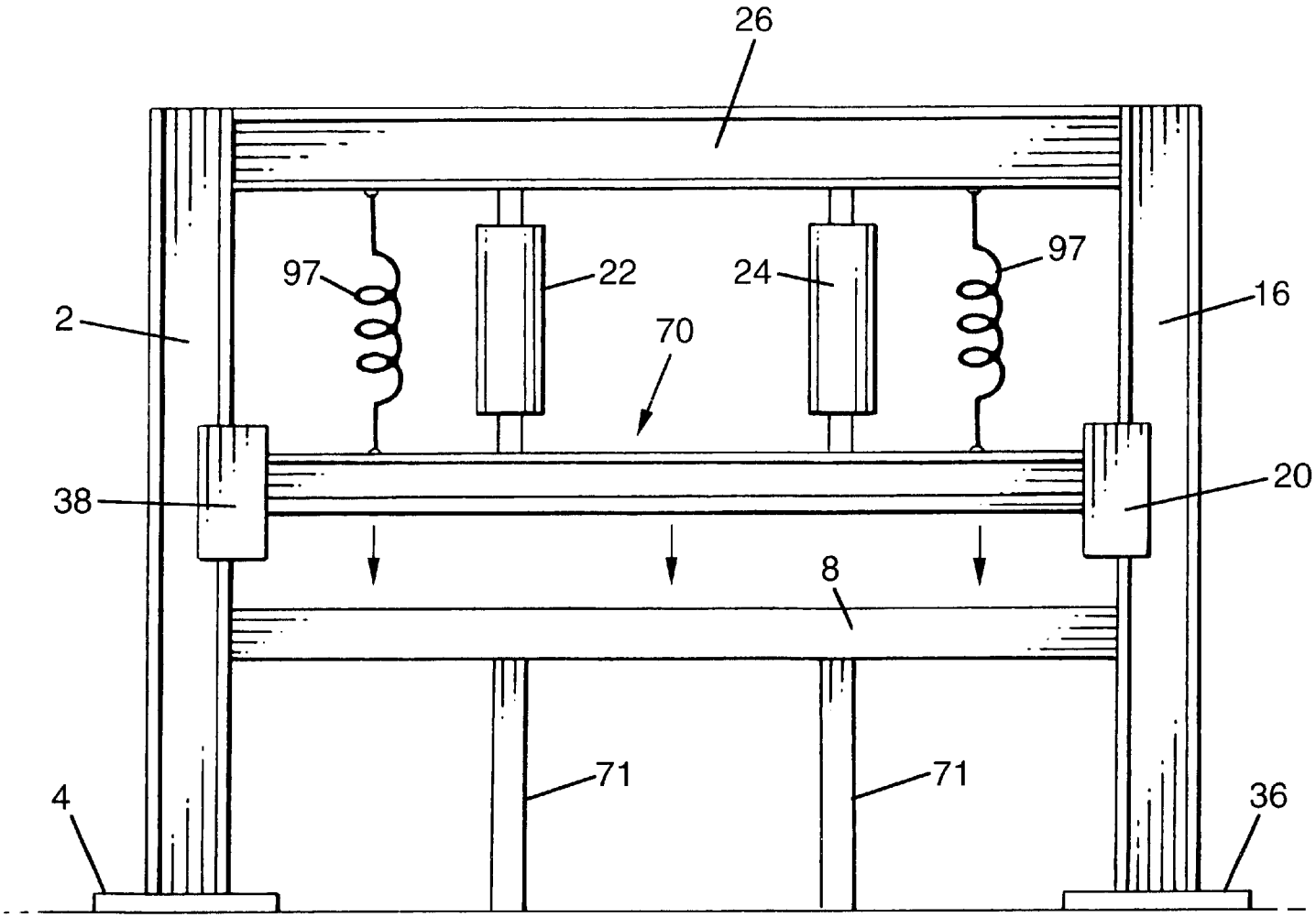
FIG. 2 is a front view of a device according to the invention.

Also shown in FIG. 1, and more clearly in FIG. 2, are supports 71 which are disposed between the lower surface of the second horizontal support member 8 and the floor or other surface upon which the device as a whole of the invention is caused to rest in its normal position during use. The purpose of the supports is to lend additional strength to the second horizontal support member 8 in order to lessen the tendency of the second horizontal support member 8 to distort after the device of the invention has been in extended service.

A workpiece 99 which is simply a log is also shown in position atop the flat upper surface of second horizontal support member 8 which is the position it would normally be in immediately prior to energization of the actuator means. The log to be split may be comprised of any wood, including hardwoods.

FIG. 2 shows a device of the invention as in FIG. 1, including vertical support members 2, 16; horizontal support members 26, 8; support stabilizers 4, 36; actuator means 22, 24; guide means 38, 20; cutting means 70; support members 71; and springs 97. In this figure are more clearly shown the relationship of the support members 71 with respect to the surface on which the device as a whole of the invention rests and the second horizontal support member 8, and the support members 71 are preferably attached to the second horizontal support member 8, as are other elements of the invention which require attachment to one another, by welding or fastening means known to those skilled in the art, including without limitation screws, rivets, nuts and bolts, and the like. The support members 71 are preferably constructed of tubular steel, but their exact construction is not critical, provided they provide support of second horizontal support member 8 in a direction opposite to that delivered to second horizontal support member 8 by energization of the actuator means when a workpiece is in position on the upper surface of second horizontal support member 8.

Safety springs 97 are shown attached to the lower surface of the upper horizontal support member 26 and the cutting means 70. These springs provide a mechanical bias of the cutting means in any amount desired by the user of the device, depending upon selection of a spring having an appropriate spring constant, the selection of which is well within the skill level of one of ordinary skill in the art without undue experimentation. It is preferred that the springs are chosen so that the cutting means is held in position above the top surface of second horizontal support member 8 a distance greater than about four inches, to prevent accidents arising from the downward motion of the cutting means 70 when a workperson's hand or other limb may be in the region of motion of the cutting means 70. FIG. 2 also shows the respective locations of guide plates 38, 20 which are simply flat pieces of sheet stock which have been affixed to the vertical support members 2, 16 preferably by welding.

Figure 3A:
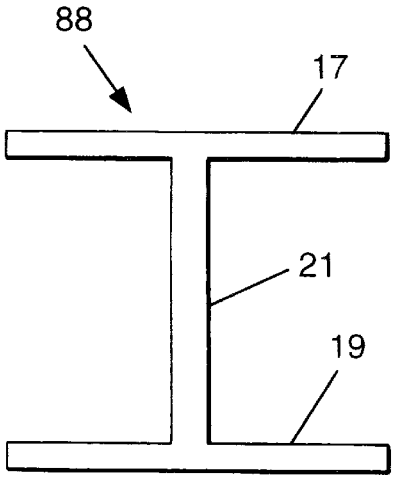
FIG. 3A PRIOR ART
FIG. 3A is a sectional view of a steel I-beam according to the prior art.
Figure 3B:
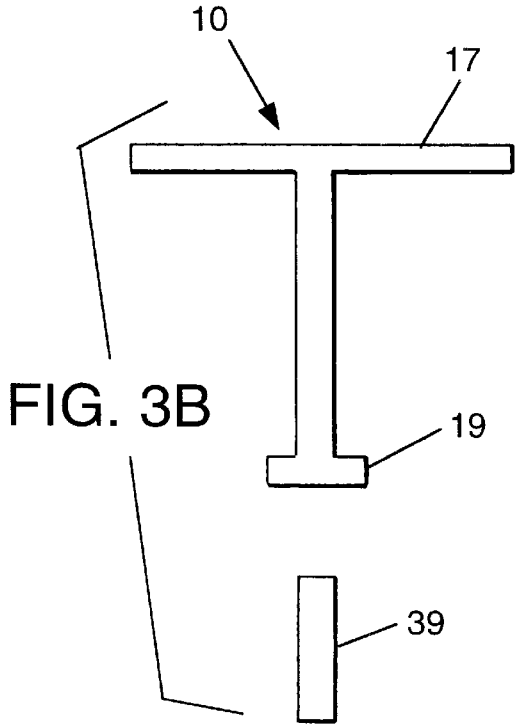
FIG. 3B is a sectional view of a steel I-beam according to the prior art which has had one of its legs cut on both sides of the main rail, and a sectional view of a piece of steel bar stock.
Figure 3C:
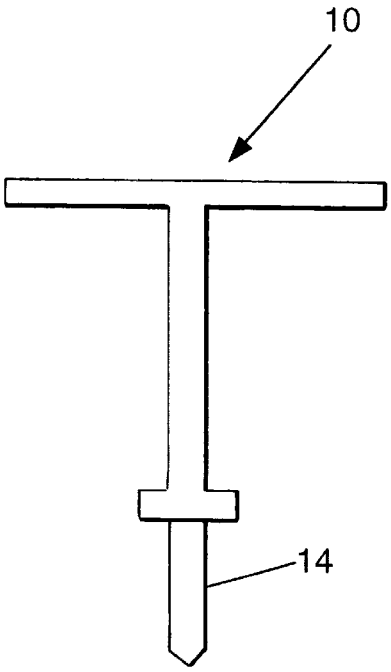
FIG. 3C is a sectional view of a steel I-beam according to the prior art which has had one of its legs cut on both sides of the main rail, and a sectional view of a piece of steel bar stock which has been sharpened on one of its edges, wherein the remaining flat edge of the bar stock has been affixed to the I-beam.
Figure 3D:
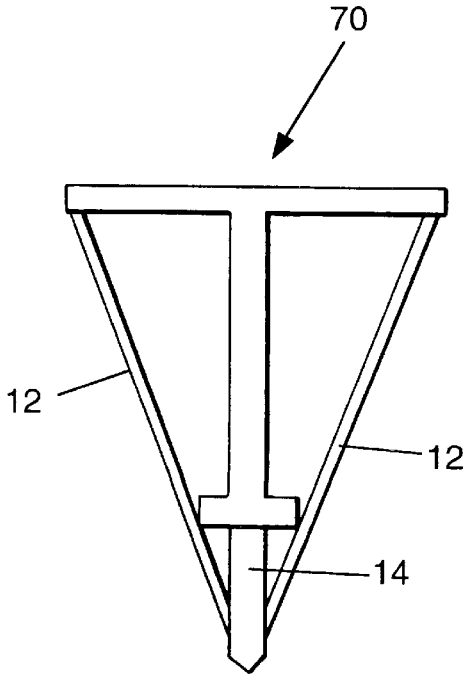
FIG. 3D is a sectional view of a cutting blade according to the invention.

FIG. 3A shows an i-beam of the prior art that is often used in construction which comprises a main rail portion 21, a first leg portion 17, and a second leg portion 19. FIG. 3B shows a sculpted I-beam of the prior art 10 which has had its second leg portion 19 trimmed to a width less than the first leg portion 17, as well as a section view of bar stock 39 which is to be used as the blade portion of the cutting means. FIG. 3C shows the sharpened bar stock 14 attached to the sculpted I-beam to form a blade/beam composite. FIG. 3D shows the blade/beam composite of FIG. 3C further comprising strengthening members in contact with the first and second leg portions 17 and 19, and the blade means 14.

The cutting means of the invention may comprise any wedge-shaped geometrical solid having a sharp edge portion which extends longitudinally along its length dimension. A suitable cutting means may be a simple triangularly-shaped wedge. However, it is preferred that the cutting means be that as set forth herein and as pictorially described in FIGS. 3 and 4. Such a cutting means may be prepared readily by selecting a section of I-beam stock 88 as shown in cross section in FIG. 3A wherein the i-beam includes a main rail portion 21, a first leg portion 17 and a second leg portion 19. The second leg portion is then trimmed using known means such as either an oxy/acetylene torch, hacksaw, laser, or other abrasive cutting means to provide an i-beam having the cross section as shown in FIG. 3B, which cross section represents a sculpted I-beam 10. A piece of rectangular bar stock from which the blade portion is to be fabricated is selected. The bar stock is preferably steel or iron, but all other metallic alloys, including without limitation high carbon steels, titanium, stainless steel, etc. are suitable functional equivalents. The bar stock is sharpened along one of its ends in order to arrive at a blade portion which is a pentagonal solid, as shown in FIG. 3C attached to the sculpted I-beam 10 at the flat end of the pentagon which is opposite to the cutting edge. Finally, the structure shown in FIG. 3C is strengthened by the addition of a plurality of strengthening members 12 disposed along the length of both sides of the preferred cutting means. The strengthening members 12 are preferably comprised of plate stock, although other materials are suitable provided they include a flat edge portion. The flat edge portion of the plate stock is attached to the composite of FIG. 3C (preferably by welding) in such fashion that the flat edge portion of a strengthening member is in simultaneous contact with the first and second leg portions 17 and 19, and a face of the blade means 14.

Figure 4:
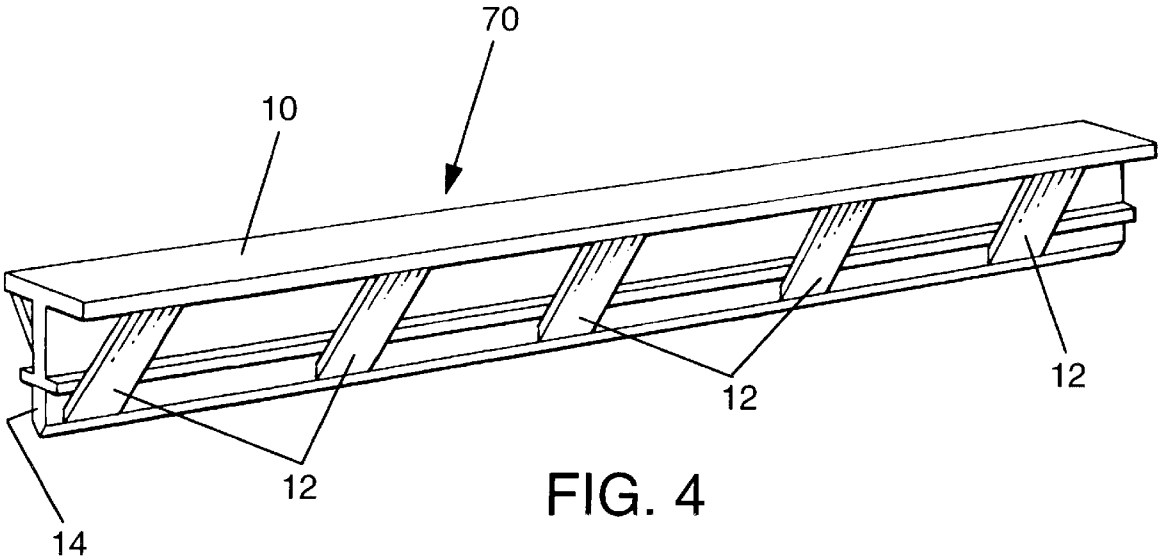
FIG. 4 is a perspective view of a cutting blade according to the invention.

FIG. 4 shows the relationship of the plurality of strengthening members 12 (on one side of the cutting means) with respect to the blade portion 14 and the first and second leg portions of the sculpted I-beam 10 on a preferred cutting means 70 according to the invention.

Figure 5:
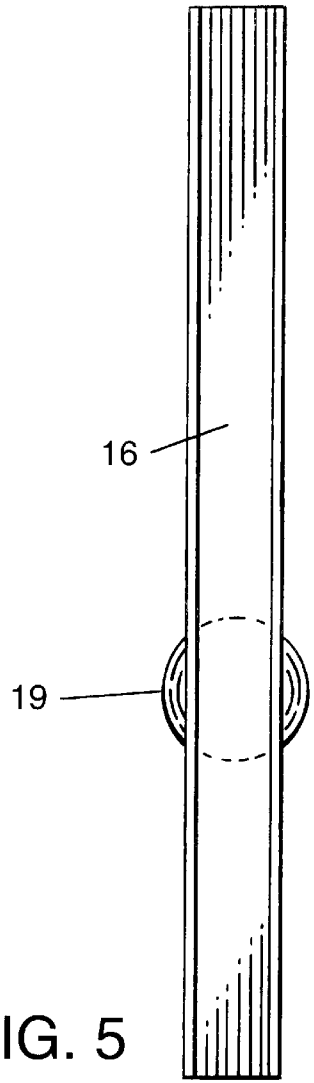
FIG. 5 is and end view of a device according to the invention.

FIG. 5 shows an end view of a device according to the invention, having a log 99 in position to be cleaved. Thus it is seen that the depth of this device is approximately equal to the dimension of the support members 16 in its preferred form, which is desirous for not requiring a lot of floor space for the device.

Figure 6:
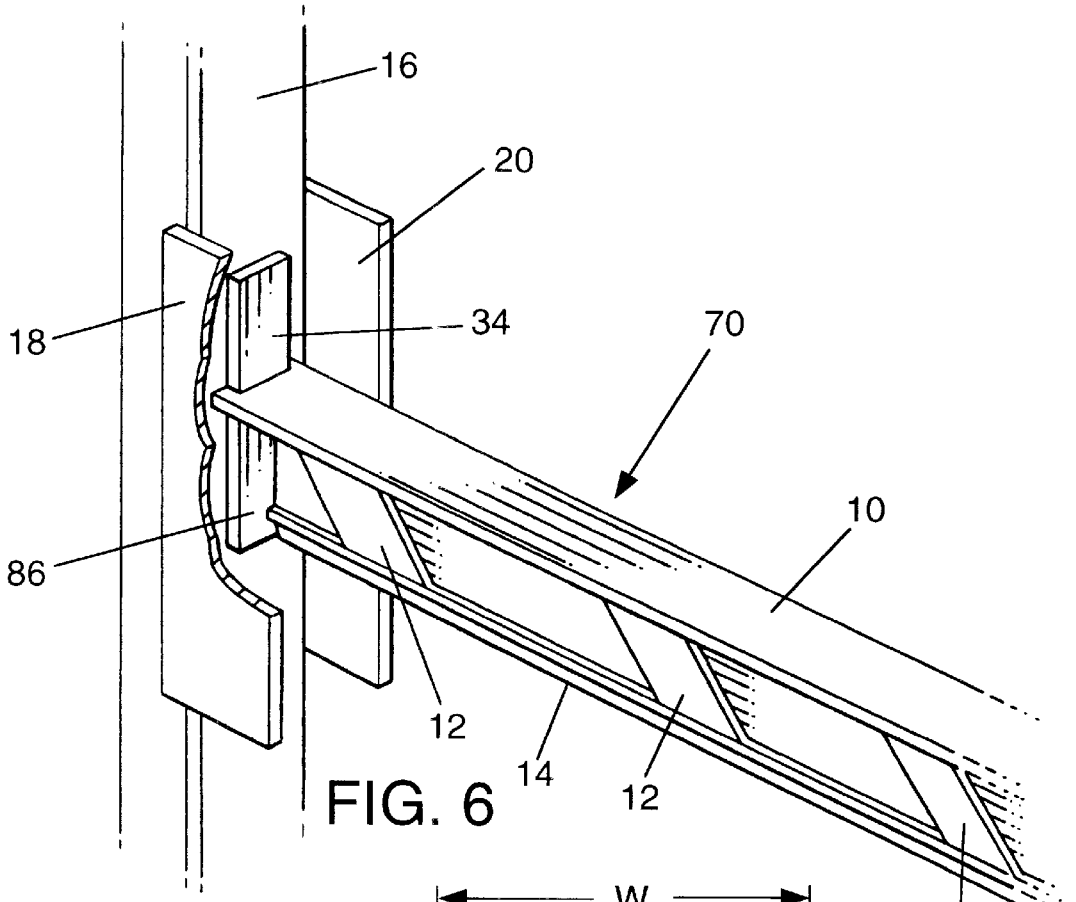
FIG. 6 is a perspective view showing a close up of a means according to the invention by which the cutting means of the invention is guided in desired position during its normal travel.

FIG. 6 shows the way in which the cutting means of the device may be guided in its intended direction of travel, (parallel to the vertical support members 2 and 16) so that the cutting means is not permitted to leave the planar region defined by the vertical and horizontal support members. Such guiding is preferably accomplished by guide means 18 and 20, which are mere plates of stock (preferably metal or any metallic alloy of sufficient strength) and are preferably comprised of steel or cast iron. The plates are affixed to the vertical support means using known methods, preferably by welding, in order to define a channel in which the ends of the cutting means 70 are free to move upward and downward. In FIG. 6 the width of the cutting means is not to scale but is narrower than normally used in the invention, for purposes of illustration. In reality, the distance between the inner faces of plates (guiding means) 18 and 20 is slightly larger than the width of the cutting means. Guide means analogous to 18 and 20 are also affixed to vertical support member 2 in the same fashion to provide a guide for the opposite end of the cutting means.

The cutting means may also optionally be equipped with stabilizing guide means 34 and 86, which are pieces of bar stock or other material which is affixed to the top and lower portions of the cutting means, to provide for the ends of the cutting means which are located in the guides formed by plates 18, 20 to have a greater height dimension, so as to render the guide means 18, 20 more effective at keeping the blade portion aimed downward towards and perpendicular to, the upper surface of the horizontal support member 8.

Figure 7:
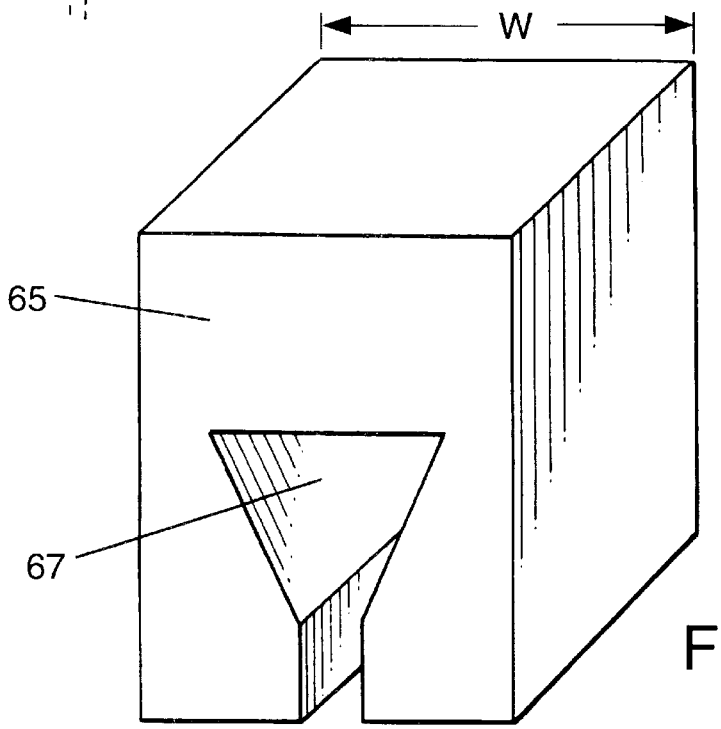
FIG. 7 is a perspective view of a guide means for the cutting means of the invention according to the invention.

Towards such end the construction of FIG. 7 has proven especially useful. In FIG. 7 is shown a block 65 of metallic stock (preferably cast iron or steel, but other metallic alloys are suitable equivalents). The block of stock in this figure has had a section 67 machined out of it which corresponds in shape to the cross section of the cutting means, to a depth of about three inches or more. One of each of such blocks maybe slipped over the ends of the cutting means, in order to take the place of stabilizing guide means 34 and 86 in providing a greater height dimension to the cutting means at its end portions in order to permit the cutting means as a whole to be more effectively guided by guide portions 18 and 20, and their counterparts which are affixed to vertical support member 2. Towards this end, the width W of the block 65 is selected to be just slightly less than the distance between the guide portions 18 and 20, and their counterparts which are affixed to vertical support member 2.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. Accordingly, the presently disclosed invention is intended to cover all such modifications and alterations, and is limited only by the scope of the claims which follow.

I claim:

1. A device useful for shaping log sections by effecting a cleavage of a log section in a direction substantially parallel to the length dimension of the log which comprises:

a) a substantially rectangularly shaped frame portion having two vertical support members and one upper and one lower horizontal support member, each horizontal support member including an upper surface portion and a lower surface portion;

b) at least one actuator means in mechanical contact with said upper horizontal support member;

c) a longitudinal cutting means oriented parallel to said horizontal support members and having a top surface portion and a cutting edge portion, said cutting means disposed between said upper horizontal support member and said lower horizontal support member and wherein said at least one actuator means is in mechanical contact with said top surface portion of said cutting means; and d) guide means for maintaining said cutting means within the plane formed by said vertical and said horizontal support members during motion of said cutting means in a direction parallel to said vertical support members induced by virtue of the action of said at least one actuator means.

2. A device according to claim 1 wherein the axis of said longitudinal cutting means is parallel to the axis of at least one of said horizontal support members.

3. A device according to claim 1 wherein the length of said longitudinal cutting means is at least one-half of the distance between said vertical support members.

4. A device according to claim 1 wherein the length of said longitudinal cutting means is at least three-fourths of the distance between said vertical support members.

5. A device according to claim 1 wherein the length of said longitudinal cutting means is at least three feet long.

6. A device according to claim 1 wherein the length of said longitudinal cutting means is at least six feet long.

7. A device according to claim 1 wherein said guide means comprises a plurality of plate portions affixed to said vertical support members so as to define a channel portion on said vertical support members.

8. A device according to claim 1 wherein said guide means comprises a pair of end caps wherein one of said pair of end caps is affixed to each end of said cutting means.

9. A device according to claim 8 wherein said guide means comprises a plurality of plate portions affixed to said vertical support members so as to define a channel portion on said vertical support members.

10. A device according to claim 1 wherein said at least one actuator means is capable of delivering at least a sufficient force to cause said cutting means to cleave a four inch diameter pine log disposed on the upper surface portion of said lower horizontal support member when activated.

11. A device according to claim 1 wherein said cutting means comprises:

a) an I-beam having i) a main rail portion having a length dimension, a width dimension and a thickness dimension, two face portions, two edge portions and two end portions, and ii) a first and a second leg portion, each having a length dimension, a width dimension and a thickness dimension, a first and second face portion, two edge portions and two end portions, wherein said first and second leg portions are connected to said main rail portion in such fashion that the first face portion of each leg portion is attached to opposite end portions of said main rail portion, and wherein the width dimension of said second leg portion is less than that of said first leg portion;

b) a blade portion existing substantially in the shape of a pentagonal solid, having a cutting edge and a flat surface opposite thereto, and two parallel face portions, wherein said flat surface portion of said blade portion is attached to the second face portion of said second leg portion, so as to form a blade/beam composite; and c) a plurality of strengthening members disposed about said blade/beam composite, wherein said strengthening members include a flat surface and in which said flat surface of said strengthening members is affixed to said composite in simultaneous contact with said parallel face portions of said blade portion, and said first and said second leg portions of said I-beam.

12. A device according to claim 1 wherein at least one of said vertical and said horizontal support members is an I-beam.

13. A device according to claim 1 further comprising at least one spring, said spring having two ends wherein the first end of the spring is in mechanical contact with the upper support member and wherein said second end of the spring is in mechanical contact with said cutting means, such that said cutting means is mechanically biased towards said upper support member.

* * * * *